US006575236B1

(12) United States Patent
Heijnen

(10) Patent No.: US 6,575,236 B1
(45) Date of Patent: Jun. 10, 2003

(54) DEVICE FOR MANIPULATING A TOOL IN A WELL TUBULAR

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/721,603

(22) Filed: Nov. 22, 2000

(30) Foreign Application Priority Data

Nov. 24, 1999 (EP) ..... 99309365

(51) Int. Cl.[7] ..... E21B 4/04; E21B 4/16; E21B 23/00

(52) U.S. Cl. ..... 166/66.4; 166/381; 166/242.6; 175/95; 175/97

(58) Field of Search ..... 166/66.4, 381, 166/301, 98, 242.6, 123, 125, 181; 175/95, 97

(56) References Cited

U.S. PATENT DOCUMENTS 4,043,390 A * 8/1977 Glotin ..... 166/125
4,143,722 A * 3/1979 Driver ..... 175/104
4,314,615 A * 2/1982 Sodder et al. ..... 175/106
4,856,582 A * 8/1989 Smith et al. ..... 166/301
5,303,776 A 4/1994 Ryan
5,379,839 A 1/1995 Hisaw
5,398,753 A * 3/1995 Obrejanu et al. ..... 166/301
5,450,914 A * 9/1995 Coram ..... 175/113
6,196,309 B1 * 3/2001 Estilette, Sr. ..... 166/178
6,230,813 B1 * 5/2001 Moore et al. ..... 166/381
6,273,189 B1 * 8/2001 Gissler et al. ..... 166/241.1

FOREIGN PATENT DOCUMENTS

DE 3625898 A1 * 2/1988 ..... 166/98
GB 2119426 A * 11/1983 ..... E21B/23/02

OTHER PUBLICATIONS

Search Report Dated Sep. 2, 2001.

* cited by examiner

*Primary Examiner*—David Bagnell
*Assistant Examiner*—Jennifer H Gay

(57) ABSTRACT

A device is provided for manipulating a tool in a well tubular. The device includes a cylindrical housing having a front end and a rear end, and radially extendible dogs for securing the device in the well tubular. A shaft is also included that is axially displaceable and rotatable from the front end of the device. The shaft is extendable from a displaceable sleeve, the displaceable sleeve also being extendable from the front end of the device. The outwardly extending end parts of the shaft and of the sleeve are provided with is effective for holding a tool.

11 Claims, 1 Drawing Sheet

DEVICE FOR MANIPULATING A TOOL IN A WELL TUBULAR

FIELD OF THE INVENT

The present invention relates to a device for manipulating a tool in a well tubular.

BACKGROUND TO THE INVENTION

Such a tool can be any tool used downhole, such as a sub-surface safety valve, a packer or a gas lift valve. The expression 'manipulating a tool in a well tubular' is used to refer to running a tool into the well tubular, operating the tool and to retrieving the tool from the well tubular. Such a tool can be any tool used downhole, such as a sub-surface safety valve, a packer or a gas lift valve. The well tubular can be any well tubular, such as a casing, a liner or a production tubing.

It is an object of the present invention to provide a device that can be used to set and retrieve a complex tool without jarring.

SUMMARY OF THE INVENTION

To this end the device according to the present invention for manipulating a tool in a well tubular comprises a cylindrical housing having a front end and a rear end, radially extendible dogs for securing the device in the well tubular arranged at the rear end of the housing, an axially displaceable and rotatable shaft extending from the front end, and an axially displaceable sleeve extending from the front end surrounding the shaft, wherein the outwardly extending end parts of the shaft and of the sleeve are provided with means for holding a tool.

DESCRIPTION OF A PREFERRED EMBODIMENT

Figure 1A:
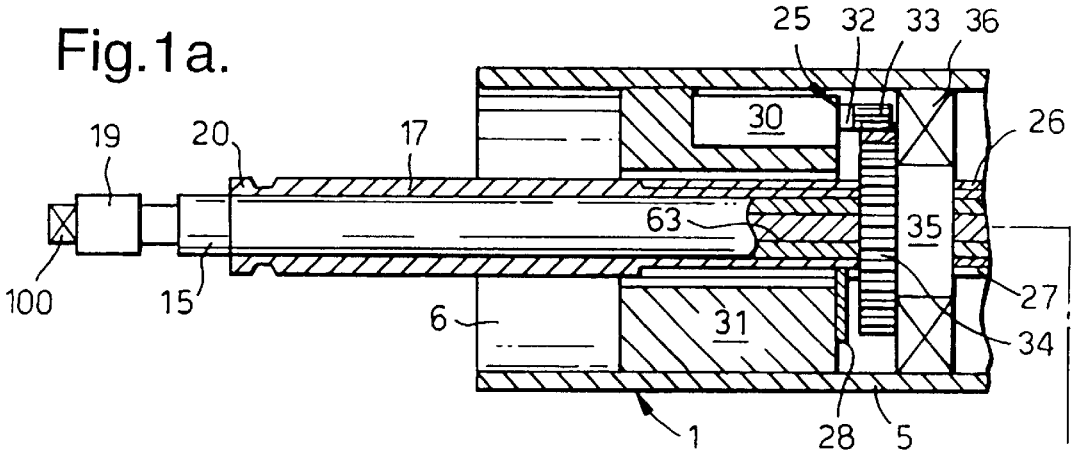
FIGS. 1*a* through 1*c* show schematically sucessive parts of a partial longitudinal section of the device.
Figure 1B:
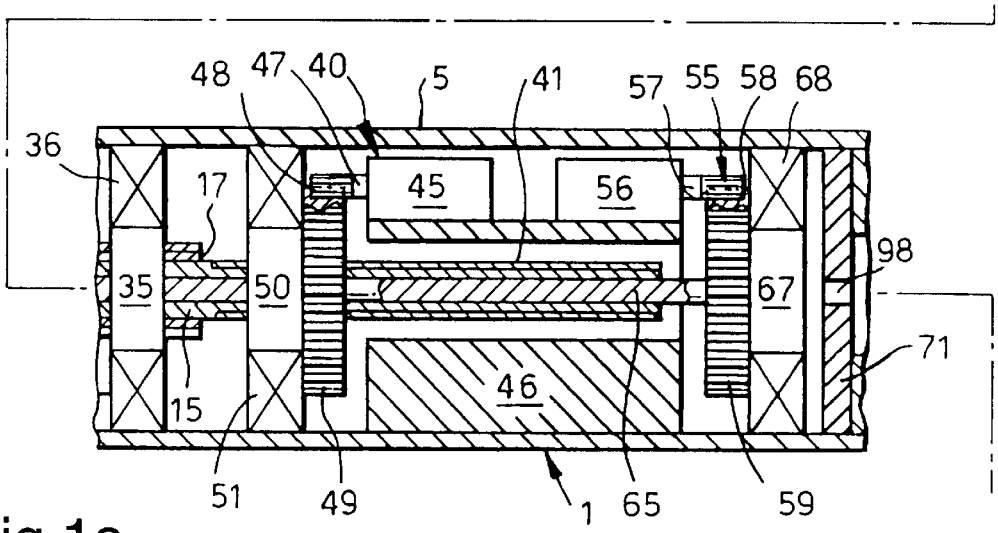
Figure 1C:
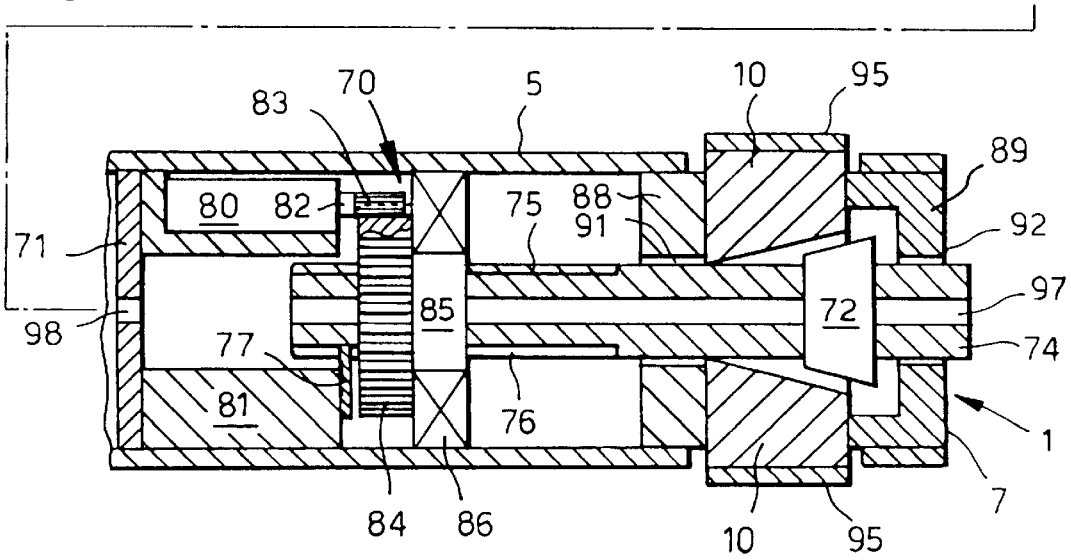

The invention will now be discussed by way of example in more detail with reference to FIGS. 1*a* through 1*c*.

The device 1 comprises a cylindrical housing 5 having a front end 6 and a rear end 7. The device 1 further comprises a plurality radially extendible dogs 10 for securing the device 1 in the well tubular (not shown). The dogs 10 are arranged at the rear end 7 of the housing 5. In FIG. 1 only two dogs 10 have been shown, however, the number of dogs 10 is suitably between 2 and 4, and they are arranged at regular intervals along the circumference of the device 1.

The device comprises an axially displaceable and rotatable shaft 15 extending from the front end 6, and an axially displaceable sleeve 17 extending from the front end 6. The axially displaceable sleeve 17 surrounds the axially displaceable and rotatable shaft 15. The outwardly extending end parts of the 15 shaft and of the sleeve 17 are provided with means 19, 20 for holding a tool (not shown).

At the rear end 7, the device 1 is provided with means (not shown) for connecting the device 1 to the lower end of a drill string (not shown) for running the device 1 in the well tubular (not shown). In place of a drill string, one can use a wire line or a coil tubing.

The device 1 is provided with a first drive system 25 arranged near the front end 6. The first drive system 25 is capable, during normal operation to axially displace the sleeve 17. To enable axially displacing the sleeve 17, the rear end part of the sleeve 17 is provided with a screw thread 26. To prevent rotation of the sleeve 17, the device 1 comprises means for preventing rotation of the sleeve 17, which means comprise an axial groove 27 arranged in the rear end part of the sleeve 17 and a finger 28 co-operating with the axial groove 27. The first drive system 25 comprises a first electric motor 30 arranged in a motor housing 31 that is secured in the cylindrical housing 5. The first electric motor 30 is provided with a shaft 32 on which a pinion 33 is arranged that co-operates with a gear 34 having a central opening (not shown) provided internally with a screw thread (not shown) that co-operates with the screw thread 26 on the rear end part of the sleeve 17. The gear 34 is secured to a hollow shaft 35 that is supported in the cylindrical housing 5 by means of a bearing 36. The finger 28 is attached to the motor housing 31. The hollow shaft 35 allows the passage of the sleeve 17 and the shaft 15 therethrough.

The device 1 is further provided with a second drive system 40 for axially displacing the shaft 15. The second drive system 40 is arranged to the rear of the first drive system 25. To enable axially displacing the shaft 15, the rear end part of the shaft 15 is provided with a screw thread 41. The second drive system 40 comprises a second electric motor 45 in a motor housing 46 that is secured in the cylindrical housing 5. The second electric motor 45 is provided with a shaft 47 on which a pinion 48 is arranged that co-operates with a gear 49 having a central opening (not shown) provided internally with a screw thread that co-operates with the screw thread 41 on the rear end part of the shaft 15. The gear 49 is secured to a hollow shaft 50 that is supported in the cylindrical housing 5 by means of a bearing 51. The hollow shaft 50 allows passage of the shaft 15 therethrough.

In order to allow during normal operation rotating the shaft 15, the device 1 is further provided with a third drive system 55 for rotating the shaft 15. The third drive system 55 is arranged to the rear of the second drive system 40. To allow rotating the shaft 15, the rear end part of the shaft 15 is further provided with means for conveying a rotation. The third drive system 55 comprises a third electric motor 56 that is arranged in the motor housing 46. The third electric motor 56 is provided with a shaft 57 on which a pinion 58 is arranged that co-operates with a gear 59 that is connected to the means for conveying a rotation. The means for conveying a rotation comprise an axial bore 63 extending into the rear end part of the shaft 15 and having a square cross-section, and a rod 65 having a square cross-section connected with one end to the gear 59, wherein the free end of the rod 65 is slideably arranged in the axial bore 63. The gear 59 is secured to a hollow shaft 67 that is supported in the cylindrical housing 5 by means of a bearing 68.

The device 1 further comprises a system 70 for driving the dogs 10 arranged near the rear end 7, in a separate compartment separated by means of a wall 71.

The system 70 for driving the dogs 10 comprises a tapered pusher body 72 for pushing the dogs 10 outwardly. During normal operation, axial displacement of the tapered pusher body 72 causes the dogs 10 to move outwardly. In order to enable axially displacing the pusher body 72, the pusher body 72 is secured to an axially displaceable drive shaft 74 provided at its free end with a screw thread 75. To prevent rotation of the axially displaceable drive shaft 74, the device 1 comprises means for preventing rotation of the drive shaft 74 in the form of an axial groove 76 arranged in the free end part of the drive shaft 74 and a finger 77 co-operating with the axial groove 76, wherein the free end part is the end part of the drive shaft 74 opposite the pusher body 72. The drive system 70 further comprises an electric motor 80 arranged in a motor housing 81. The electric motor 80 is provided with a shaft 82 on which a pinion 83 is arranged that co-operates with a gear 84 having a central opening (not shown) provided internally with a screw thread that co-operates with the screw thread 75 on the free end part of the drive shaft 74. The gear 84 is secured to a hollow shaft 85 that is supported in the cylindrical housing 5 by means of a bearing 86. The hollow shaft 85 allows passage of the drive shaft 74 therethrough. The radially extendible dogs 10 are guided by means of covers 88 and 89 provided with a central opening 91, 92 through which the axially displaceable drive shaft 74 can pass. The finger 77 is secured to the motor housing 81.

Suitably the radially extendible dogs 10 are provided with pads 95 to increase the friction when the radially extendible dogs 10 are pushed against the inner surface of the well tubular (not shown).

The advantage of the device 1 according to the present invention is that it can exercise on a tool a force to pull or to push the tool and a torque to rotate the tool. Thus the device according to the present invention can be used to set and retrieve a complex tool without jarring.

The device 1 can be run on a cable, a drill pipe or a coil tubing.

It can be provided with a battery pack (not shown) that provides the power for the electric motors, or it can be powered from surface by means of an electric cable (not shown) that runs through a passage, which passage includes a central bore 97 in the axially displaceable drive shaft 74, an opening 98 in the wall 71 and the opening in the hollow shaft 67.

Suitably, the device 1 further comprises a connector 100 permitting optical or electrical communication with the tool (not shown) carried by the device 1. The signals from the tool are passed via the connector 100 through a conduit (not shown) that is arranged in a longitudinal central passage (not shown) in the axially displaceable and rotatable shaft 15. In this way, monitoring of a well can be done with a suitable tool connected to the device according to the invention. The connection can be an electrical or an optical connection.

For the sake of clarity, bushings to keep the parts of the device 1 at a predetermined distance have not been shown, nor are shown seals.

The screw threads 26, 41 or 75 can be a single screw thread or a multiple one.

The electric motors 30, 45, 56 and 80 are single motors. Alternatively, the single motors can be replaced by a motor comprising a number of motor elements that are arranged radially around the central longitudinal axis of the device 1.

I claim:

1. A device for manipulating a tool in a well tubular comprising a cylindrical housing having a front end and a rear end, radially extendible dogs for securing the device in the well tubular by pushing against the inner surface of the well tubular, the radially extendable dogs arranged at the rear end of the housing, an axially displaceable and rotatable shaft extending from the front end, and an axially displaceable sleeve extending from the front end surrounding the rotatable shaft, wherein the outwardly extending end parts of the rotatable shaft and of the sleeve are provided with means for holding the tool.

2. Device according to claim 1, which device is provided with a first drive system arranged near the front end for axially displacing the sleeve.

3. Device according to claim 2, wherein the rear end part of the sleeve is provided with a screw thread, wherein the device comprises means for preventing rotation of the sleeve, and wherein the first drive system comprises a first electric motor provided with a first drive system shaft on which a pinion is arranged that co-operates with a first drive system gear having a central opening provided internally with a screw thread that co-operates with the screw thread on the rear end part of the sleeve.

4. Device according to claim 3, which device is further provided with a second drive system for axially displacing the rotatable shaft, which second drive system is arranged to the rear of the first drive system.

5. Device according to claim 4, wherein the rear end part of the rotatable shaft is provided with a screw thread, and wherein the second drive system comprises a second electric motor provided with a second drive system shaft on which a second drive system pinion is arranged that co-operates with a second drive system gear having a central opening provided internally with a screw thread that co-operates with the screw thread on the rear end part of the rotatable shaft.

6. Device according to claim 4, which device is further provided with a third drive system for rotating the rotatable shaft, which third drive system is arranged to the rear of the second drive system.

7. Device according to claim 6, wherein the rear end part of the rotatable shaft is further provided with means for conveying a rotation, and wherein the third drive system comprises a third electric motor provided with a third drive system shaft on which a third drive system pinion is arranged that co-operates with a third drive system gear that is connected to the means for conveying a rotation.

8. Device according to claim 7, wherein the means for conveying a rotation comprise an axial bore extending into the rear end part of the rotatable shaft and having a square cross-section, and a rod having a square cross-section connected with one end to the gear, wherein the free end of the rod is slideably arranged in the axial bore.

9. Device according to claim 1, further comprising a system for driving the dogs arranged near the rear end.

10. Device according to claim 9, wherein the system for driving the dogs comprises a pusher body for pushing the dogs outwardly, which pusher body is secured to an axially displaceable drive shaft provided at its free end with a screw thread, means for preventing rotation of the axially displaceable drive shaft, an electric motor provided with a fourth drive system shaft on which a fourth drive system pinion is arranged that co-operates with a fourth drive system gear having a central opening provided internally with a screw thread that co-operates with the screw thread on the free end part of the axially displaceable drive shaft.

11. Device according to claim 1, further comprising a cable being arranged in a passage through the center of the device enabling electrical or optical connection to a suitable tool that is connected to means for holding a tool.

* * * * *